US007361005B2

(12) United States Patent
Sato

(10) Patent No.: US 7,361,005 B2
(45) Date of Patent: Apr. 22, 2008

(54) ROTARY COMPRESSOR HAVING DISCHARGE MUFFLING

(75) Inventor: Kazuya Sato, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 11/592,157

(22) Filed: Nov. 3, 2006

(65) Prior Publication Data

US 2007/0104590 A1 May 10, 2007

(30) Foreign Application Priority Data

Nov. 9, 2005 (JP) ..... 2005-324235

(51) Int. Cl.
*F03C 4/00* (2006.01)
*F04C 2/00* (2006.01)

(52) U.S. Cl. ..... 418/60; 418/63; 418/181

(58) Field of Classification Search ..... 418/60, 418/63, 97, 181, DIG. 1
See application file for complete search history.

(56) References Cited

U.S. PATENT DOCUMENTS 2,764,342 A * 9/1956 Dills ..... 418/181
3,130,902 A * 4/1964 Brown ..... 418/63
4,636,154 A * 1/1987 Sugiyama et al. ..... 418/97

FOREIGN PATENT DOCUMENTS

JP 01182595 A * 7/1989 ..... 418/181
JP 2001082371 A * 3/2001
JP 2003-97473 4/2003

* cited by examiner

*Primary Examiner*—Theresa Trieu
(74) *Attorney, Agent, or Firm*—Kratz, Quintos & Hanson, LLP

(57) ABSTRACT

A high inner pressure type multistage compression rotary compressor having a support member blocking an opening of a cylinder constituting the rotary compression element and having a bearing of a rotary shaft. The surface of the support member on a side opposite to the cylinder is depressed, and a rib is added to a part of this depressed portion. A discharge muffling chamber formed in the surface of the support member on the side opposite to the cylinder is divided into a plurality of discharge muffling chambers, and the divided discharge muffling chambers are connected to each other by a passage disposed it a blocking plate and/or the rib.

1 Claim, 4 Drawing Sheets

ROTARY COMPRESSOR HAVING DISCHARGE MUFFLING

BACKGROUND OF THE INVENTION

1. Field of the Invention

The present invention relates to a rotary compressor including, in a sealed vessel, a driving element and a rotary compression element driven by a rotary shaft of this driving element.

2. Description of the Related Art

Heretofore, a rotary compressor such as a multistage compression type rotary compressor including first and second rotary compression elements includes, in a sealed vessel, a driving element and the first and second rotary compression elements driven by a rotary shaft of this driving element.

The first and second rotary compression elements include an intermediate partition plate; upper and lower cylinders disposed on and under this intermediate partition plate; rollers which are fitted into eccentric portions disposed on a rotary shaft with a phase difference of 180 degrees to eccentrically rotate in these cylinders; vanes which abut on the rollers to define the insides of the cylinders into low pressure chamber sides and high pressure chamber sides, respectively; an upper support member and a lower support member which block an upper opening surface of the upper cylinder and a lower opening surface of the lower cylinder and which have bearings of the rotary shaft, respectively; and upper and lower discharge muffling chambers. Each discharge muffling chamber is connected to the high pressure chamber side in each cylinder by a discharge port. In each discharge muffling chamber, a discharge valve is disposed which openably blocks the discharge port. An O-ring is attached to the surface of the lower support member on which the bearing and the blocking plate abut, and the discharge muffling chamber formed in an outer periphery of the bearing is sealed with the ring (see, e.g., Japanese Patent Application Laid-Open No. 2003-97473).

Here, each discharge muffling chamber is sealed with the O-ring between the bearing and the blocking plate as described above, but heretofore refrigerant leakage is generated from the surface on which the bearing and the blocking plate abut, and improvement of a sealing property of the discharge muffling chamber has been demanded.

Especially in a high inner pressure type multistage compression rotary compressor including the sealed vessel having a high pressure, there is a large pressure difference between the discharge muffling chamber of the first rotary compression element having an intermediate pressure and the sealed vessel having a high pressure. Since there is such a pressure difference, the sealing property of the discharge muffling chamber cannot be secured by disposing the conventional O-ring only, and deterioration of a volume efficiency is incurred.

In a case where an O-ring having a sealing width larger than that of the conventional O-ring is attached to the bearing in order to improve such a sealing property of the discharge muffling chamber, a thickness dimension of the bearing on an outer diameter side of an O-ring groove decreases owing to enlargement of the O-ring groove. Especially, as to the bearing having the discharge valve on an outer peripheral surface thereof, the outer peripheral surface of the bearing is formed into a shape cut by the discharge valve. Therefore, when the O-ring groove enlarges, it is not possible to secure the thickness of the bearing on the side of the outer diameter of the O-ring in the vicinity of the discharge valve.

Moreover, in a case where an concave portion is formed in the whole periphery of a bearing portion to constitute the discharge muffling chamber, deformation of a seal portion is caused owing to shortage of strength of the bearing portion, and the sealing property is deteriorated.

On the other hand, in a case where the diameter of the bearing is enlarged in order to enlarge the O-ring groove and increase the strength of the bearing, the discharge muffling chamber formed in the outer periphery of the bearing is reduced, and an effect of muffling a refrigerant discharged from the cylinder is reduced. Moreover, a position of the discharge port needs to be changed, and the deterioration of the volume efficiency is also caused.

SUMMARY OF THE INVENTION

A rotary compressor of the present invention includes, in a sealed vessel, a driving element, a rotary compression element driven by a rotary shaft of this driving element and a support member blocking an opening of a cylinder forming this rotary compression element and having a bearing or the rotary shaft. The surface of this support member on a side opposite to the cylinder is depressed, ribs which reinforce a support member bearing portion are added to a part of this depressed portion, and a sealing property is enhanced. A discharge muffling chamber formed in the surface of the support member on the side opposite to the cylinder is divided into a plurality of chambers by the ribs, and a communication passage is disposed which communicates with the divided discharge muffling chambers.

As described above in detail, according to the present invention, the rotary compressor includes, in the sealed vessel, the driving element and the rotary compression element driven by this driving element. The rotary compressor further comprises the cylinder constituting the rotary compression element and the support member which blocks the opening surface of this cylinder. The surface of this support member on the side opposite to the cylinder is depressed, and the ribs which reinforce the support member bearing portion are added to a part of the depressed portion. Distortion, deflection and the like due to strength shortage are decreased. In consequence, the sealing property can be enhanced, a volume efficiency can be improved and a performance can be enhanced. Moreover, since the communication passage is disposed to connect the plurality of discharge muffling chambers defined by the ribs to one another, an expansion muffler effect of the discharge muffling chamber is enhanced.

DETAILED DESCRIPTION OF THE PREFERRED EMBODIMENTS

In the present invention, rigidity of a lower support member bearing portion of a rotary compressor is increased to thereby enhance a sealing property, improve a volume efficiency and enhance a performance. A discharge muffling chamber formed in the surface of the lower support member on a side opposite to a cylinder is divided into a plurality of chambers by ribs, and a communication passage which communicates with the divided discharge muffling chambers is disposed. In consequence, a muffler effect of the discharge muffling chamber is enhanced.

Embodiment 1

Figure 1:
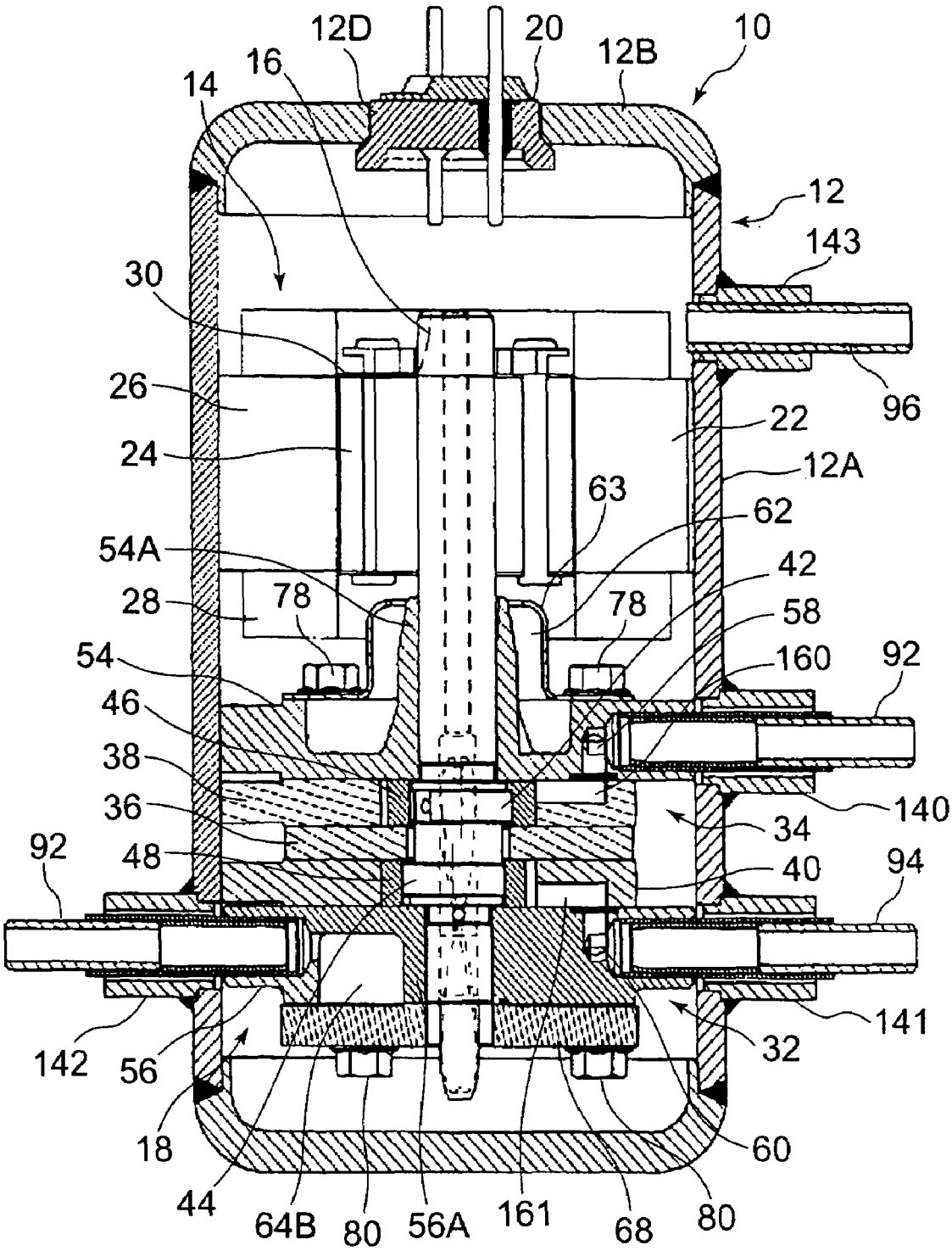
FIG. 1 is a vertical side view of a rotary compressor in an embodiment of the present invention.
Figure 2:
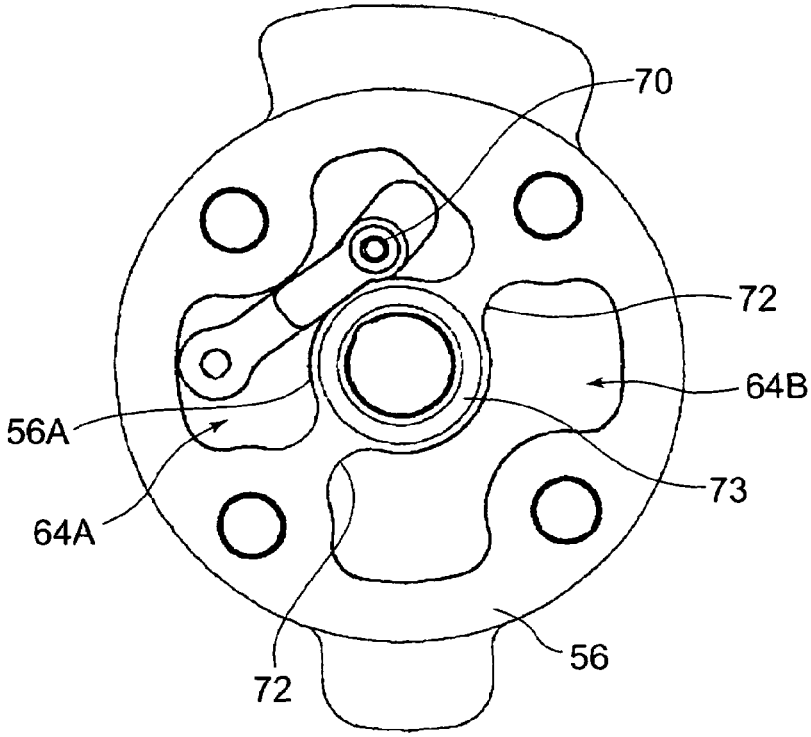
FIG. 2 is a plan view of a lower support member in the embodiment of the present invention.
Figure 3:
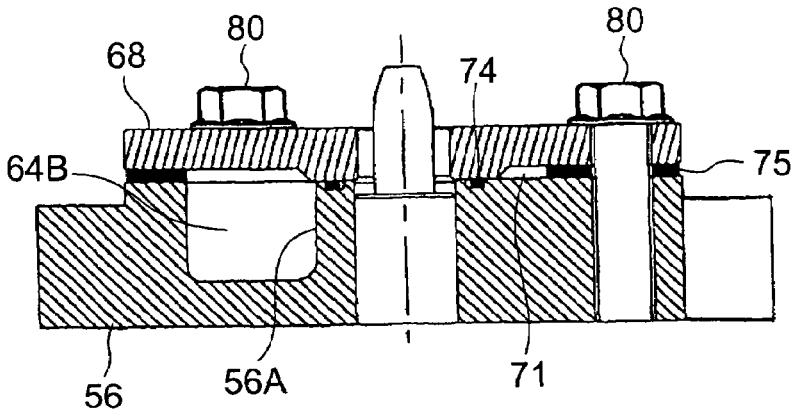
FIG. 3 is a sectional view showing the lower support member and a blocking plate during attaching of them in the embodiment of the present invention.

Next, an embodiment of the present invention will be described with reference to the drawings. FIG. 1 shows, as an embodiment of a rotary compressor of the present invention, a high inner pressure type rotary compressor 10 including first and second rotary elements 32, 34.

In FIG. 1, the rotary compressor 10 of the present embodiment is the high inner pressure type rotary compressor 10 including, in a vertically cylindrical sealed vessel 12 constituted of a steel plate, an electromotive element 14 as a driving element disposed in an upper space of this sealed vessel 12 and a rotary compression mechanism portion 18 constituted of first and second rotary compression elements 32, 34 disposed under this electromotive element 14 and driven by a rotary shaft 16 of the electromotive element 14. It is to be noted that in the rotary compressor 10 of the present embodiment, carbon dioxide is used as a refrigerant.

The sealed vessel 12 is constituted of a vessel main body 12A having a bottom part as an oil reservoir and containing the electromotive element 14 and the rotary compression mechanism portion; and a substantially bowl shaped end cap (lid body) 12B which blocks an upper opening of this vessel main body 12A. Moreover, a circular attachment hole 12D is formed in the top of this end cap 12B, and a terminal (a wiring line is omitted) 20 for supplying a power to the electromotive element 14 is attached to this attachment hole 12D.

The electromotive element 14 is constituted of an annular stator 22 fixed along an inner peripheral surface of the upper part of the sealed vessel 12 by welding; and a rotor 24 inserted in the element so that a slight interval is disposed between the rotor and an inner periphery of the stator 22. This rotor 24 is fixed to the rotary shaft 16 passed through the center of the element in a vertical direction.

The stator 22 has a laminated article 26 constituted by laminating donut-shaped electromagnetic steel plates; and a stator coil 28 wound around teeth portions of this laminated article 26 by a direct winding (concentrated winding) system. Moreover, the rotor 24 is formed of a laminated article 30 constituted of electromagnetic steel plates in the same manner as in the stator 22.

An intermediate partition plate 36 is sandwiched as an intermediate partition member between the first rotary compression element 32 and the second rotary compression element 34, the second rotary compression element 34 as a second stage is disposed on the side of the electromotive element 14 in the sealed vessel 12, and the first rotary compression element 32 as a first stage is disposed on a side opposite to the electromotive element 14. That is, the first rotary compression element 32 and the second rotary compression element 34 include a lower cylinder 40 as a first cylinder and an upper cylinder 38 as a second cylinder which constitute the first and second rotary compression elements 32, 34; and the intermediate partition plate 36 interposed between the cylinders 38 and 40 to block an (upper) opening of the lower cylinder 40 on the side of the electromotive element 14 and a (lower) opening of the upper cylinder 38 on a side opposite to the electromotive element 14. The elements also include a first roller 48 and a second roller 46 which are fitted into first and second eccentric portions 44, 42 disposed on the rotary shaft 16 with a phase difference of 180 degrees in the upper and lower cylinders 38, 40 to eccentrically rotate in the cylinders 38, 40, respectively; and vanes (not shown) which abut on the rollers 46, 48 to define the insides of the cylinders 38, 40 into low-pressure chamber sides and high-pressure chamber sides, respectively. The elements further include a lower support member 56 as a first support member which blocks a (lower) opening of the lower cylinder 40 on the side opposite to the electromotive element 14 and which has a bearing 56A of the rotary shaft 16; and an upper support member 54 as a second support member which blocks an (upper) opening of the upper cylinder 38 on the side of the electromotive element 14 and which has a bearing 54A of the rotary shaft 16. On outer sides of the bearings 54A, 56A of the upper and lower support members 54, 56, a cover 63 constituting a discharge muffling chamber 62 is attached to the upper support member 54, and ribs 72 which reinforce the bearing 56A are disposed in the lower support member 56. There is also disposed a blocking plate 68 which constitutes a first intermediate pressure discharge muffling chamber 64A and a second intermediate pressure discharge muffling chamber 64B divided by the ribs 72. In this case, the blocking plate 68 is provided with a communication passage 71 which connects the first intermediate pressure discharge muffling chamber 64A to the second intermediate pressure discharge muffling chamber 64B.

The upper support member 54 and the lower support member 56 include suction passages 58, 60 which communicate with the upper and lower cylinders 38, 40 via suction ports 160, 161; the discharge muffling chamber 62; and the intermediate pressure discharge muffling chambers 64A and 64B. As described above, the discharge muffling chamber 62 is formed by depressing the surface of the upper support member 54 on a side opposite to the upper cylinder 38, and blocking this depressed portion with the cover 63. The first intermediate pressure discharge muffling chamber 64A and the second intermediate pressure discharge muffling chamber 64B are formed by depressing portions other than the ribs 72 which reinforce the bearing 56A in the surface of the lower support member 56 on a side opposite to the lower cylinder 40, and blocking this depressed portion with the blocking plate 68 so that the first intermediate pressure discharge muffling chamber is connected to the second intermediate pressure discharge muffling chamber by the communication passage 71 disposed in the blocking plate 68. That is, the discharge muffling chamber 62 is blocked with the cover 63, and the first intermediate pressure discharge muffling chamber 64A and the second intermediate pressure discharge muffling chamber 64B are blocked with the blocking plate 68.

In this case, the bearing 54A is erected in the center of the upper support member 54. Around the outer periphery of the bearing 54A, the discharge muffling chamber 62 is formed by the cover 63. A gas discharged from a discharge port (not shown) passes through the discharge muffling chamber 62, and is discharged to the sealed vessel 12 from a donut-shaped gap between an upper portion of the upper bearing 54A and the cover 63.

Moreover, the bearing 56A is passed through the center of the lower support member 56. The bearing 56A substantially has a donut shape centering on the rotary shaft 16 and having a central hole through which the rotary shaft 16 passes. In the outer periphery of the bearing 56A, there are disposed the ribs 72 which reinforce the bearing 56A, the first intermediate pressure discharge muffling chamber 64A and the second intermediate pressure discharge muffling chamber 64B. An O-ring groove 73 is formed in the surface (bottom) of the bearing 56A which abuts on the blocking plate 68. On the other hand, the blocking plate 68 is formed of a donut-shaped circular steel plate, and has the communication passage 71 which connects the first intermediate pressure discharge muffling chamber 64A to the second intermediate pressure discharge muffling chamber 64B, the chambers being divided by the ribs 72 which reinforce the bearing 56A. Four portions of a peripheral part of the plate are fixed to the lower support member 56 by bolts 80 inserted from below, and the plate blocks openings in bottoms of the first intermediate pressure discharge muffling chamber 64A and the second intermediate pressure discharge muffling chamber 64B which communicate with the lower cylinder 40 of the first rotary compression element 32 by a discharge port 70. The bolts 80 are bolts for assembling the first and second rotary compression elements 32, 34, and distant ends of the bolts engage with the upper cylinder 38. That is, the upper cylinder 38 is provided with screw grooves to be engaged with screw heads formed on distant end portions of the bolts 80.

Here, there will be described a procedure to assemble the rotary compression mechanism portion 18 constituted of the first and second rotary compression elements 32, 34. First, the cover 63, the upper support member 54 and the upper cylinder 38 are positioned, two upper bolts 78, 78 to be engaged with the upper cylinder 38 are inserted from a cover 63 side (from above) in an axial center direction (downwards) to integrate the cover, the upper support member and the upper cylinder. In consequence, the second rotary compression element 34 is assembled.

Next, the second rotary compression element 34 integrated with the upper bolts 78 is inserted along the rotary shaft 16 from an upper end. Next, the intermediate partition plate 36 is assembled with the lower cylinder 40, inserted along the rotary shaft 16 from a lower end, and aligned with the upper cylinder 38 already attached. Two upper bolts (not shown) to be engaged with the lower cylinder 40 are inserted from the cover 63 side (from above) in the axial center direction (downwards) to fix the intermediate partition plate, the lower cylinder and the upper cylinder.

Moreover, after the lower support member 56 is inserted along the rotary shaft 16 from below, an O-ring 74 and a gasket 75 are attached to the surface of the lower support member 56 on which the bearing 56A and the cover abut. The blocking plate 68 is similarly inserted along the rotary shaft 16 from the lower end to close the depressed portion of the lower support member 56. The four lower bolts 80 are inserted from a blocking plate 68 side (from below) in the axial center direction (upwards), and the distant end portions of the bolts are engaged with the screw grooves formed in the upper cylinder 38, respectively, to assemble the first and second rotary compression elements 32, 34. It is to be noted that since the rotary shaft 16 is provided with the first and second eccentric portions 44, 42, the components cannot be attached to the rotary shaft 16 in an order other than the above order. Therefore, the blocking plate 68 is finally attached to the rotary shaft 16.

Thus, the second rotary compression element 34, the intermediate partition plate 36, the lower cylinder 40, the lower support member 56 and the blocking plate 68 are successively attached to the rotary shaft 16, and the four bolts 80 are inserted from below the blocking plate 68 finally attached to engage with the upper cylinder 38. In consequence, the first and second rotary compression elements 32, 34 can be fixed to the rotary shaft 16.

Moreover, in this case, as the refrigerant, carbon dioxide ($CO_2$) described above which is a natural refrigerant eco-friendly to global environments is used in consideration of combustibility, toxicity and the like, and as a lubricant, an existing oil is used such as a mineral oil, an alkyl benzene oil, an ether oil, an ester oil or a polyalkyl glycol (PAG) oil.

Furthermore, on the side surface of the vessel main body 12A of the sealed vessel 12, sleeves 140, 141, 142 and 143 are fixed by welding to positions corresponding to those of the suction passages 58, 60 of the upper support member 54 and the lower support member 56, the discharge muffling chamber 64 and the upper part of the electromotive element 14, respectively. The sleeve 140 is disposed vertically adjacent to the sleeve 141. Moreover, the sleeve 142 is substantially disposed along a diagonal line of the sleeve 141.

One end of a refrigerant introducing tube 92 for introducing a refrigerant gas into the upper cylinder 38 is inserted into the sleeve 140, and the one end of the refrigerant introducing tube 92 is connected to the suction passage 58 of the upper cylinder 38. This refrigerant introducing tube 92 passes above the sealed vessel 12 to reach the sleeve 142, and the other end of the tube is inserted into the sleeve 142 and connected to the discharge muffling chamber 64B.

Moreover, one end of a refrigerant introducing tube 94 for introducing the refrigerant gas into the lower cylinder 40 is inserted into the sleeve 141, and the one end of this refrigerant introducing tube is connected to the suction passage 60 of the lower cylinder 40. A refrigerant discharge tube 96 is inserted into the sleeve 143, and one end of this refrigerant discharge tube 96 is connected to the sealed vessel 12.

Next, there will be described an operation of the rotary compressor 10 constituted as described above. When a power is supplied to the stator coil 28 of the electromotive element 14 via the terminal 20 and a wiring line (not shown), the electromotive element 14 is started to rotate the rotor 24. When this rotor rotates, the second and first rollers 46, 48 engaged with the second and first eccentric portions 42, 44 integrated with the rotary shaft 16 eccentrically rotate in the upper and lower cylinders 38, 40.

In consequence, a refrigerant gas having a low pressure (a first stage suction pressure is about 4 MPaG) is passed through the refrigerant introducing tube 94 and the suction passage 60 formed in the lower support member 56, sucked from a low pressure chamber side into the lower cylinder 40 through the suction port 161, and compressed by operations of the first roller 48 and a vane (not shown) to obtain an intermediate pressure. The refrigerant gas having the intermediate pressure is discharged from a high pressure chamber side of the lower cylinder 40 into the first intermediate pressure discharge muffling chamber 64A formed in the lower support member 56 via the discharge port 70.

Moreover, the intermediate pressure refrigerant gas discharged into the intermediate pressure discharge muffling chamber 64A passes through the communication passage 71 disposed in the blocking plate 68, and is discharged into the intermediate pressure discharge muffling chamber 64B. The gas passes through the refrigerant introducing tube 92 connected to the intermediate pressure discharge muffling chamber 64B, and is sucked from the suction port 160 into a low pressure chamber side of the upper cylinder 38 via the suction passage 58 formed in the upper support member 54.

The sucked refrigerant gas having the intermediate pressure is compressed in a second stage by operations of the roller 46 and a vane (not shown) to constitute a refrigerant gas having a high temperature and a high pressure (about 12 MPaG). Moreover, the refrigerant gas having the high temperature and the high pressure is discharged from the high pressure chamber side of the upper cylinder 38 into the discharge muffling chamber 62 formed in the upper support member 54 via a discharge port (not shown).

Furthermore, after the refrigerant discharged into the discharge muffling chamber 62 is discharged from a communication passage (not shown) disposed in the cover 63 into the sealed vessel 12, the refrigerant passes through a gap formed in the electromotive element 14 to move to the upper part of the sealed vessel 12, and is discharged from the rotary compressor 10 through the refrigerant discharge tube 96 connected to the upper part of the sealed vessel 12.

Thus, the surface of the lower support member 56 on a side opposite to the lower cylinder 40 is depressed, and the ribs 72 which reinforce the bearing 56A are disposed in a part of the depressed portion. In consequence, deformation (distortion or deflection) of the bearing 56A can be decreased. It is also possible to thicken the O-ring groove 73 formed in the surface of the bearing 56A on which the blocking plate 68 abuts, and the O-ring 74 for use can be thickened to enhance a sealing property.

Moreover, the intermediate pressure discharge muffling chamber formed by depressing the surface of the lower support member 56 on the side opposite to the lower cylinder 40 is divided by the ribs 72, and the intermediate pressure discharge muffling chambers 64A and 64B divided in this manner are connected to each other by the communication passage 71 disposed in the blocking plate 68. In consequence, a muffler effect is enhanced, and noises generated by discharge pulsation can be decreased.

It is to be noted that in the present embodiment, as the rotary compressor, the high inner pressure type rotary compressor 10 has been described which includes the first and second rotary compression elements 32, 34, but the present invention is not limited to this rotary compressor, and may be applied to a rotary compressor including a single cylinder or a rotary compressor including three or more stage rotary elements. The present invention is not limited to the high inner pressure type rotary compressor 10, and may be applied to an intermediate inner pressure type rotary compressor in which a refrigerant compressed by a first rotary compression element is discharged into a sealed vessel and then compressed by a second rotary compression element.

Moreover, it is assumed in the present embodiment that the second rotary compression element 34 disposed on the side of the electromotive element 14 is a second stage, the first rotary compression element 32 disposed on the side opposite to the electromotive element 14 is a first stage, and the refrigerant compressed by the first rotary compression element 32 is compressed by the second rotary compression element 34. However, the present invention is not limited to the embodiment, and the refrigerant compressed by the second rotary compression element may be compressed by the first rotary compression element.

In addition, in the present embodiment, it has been described that the intermediate pressure discharge muffling chamber formed in the lower support member 56 is divided into two chambers, but the present invention is not limited to this embodiment, and may be applied to three or more divided chambers.

Figure 4:
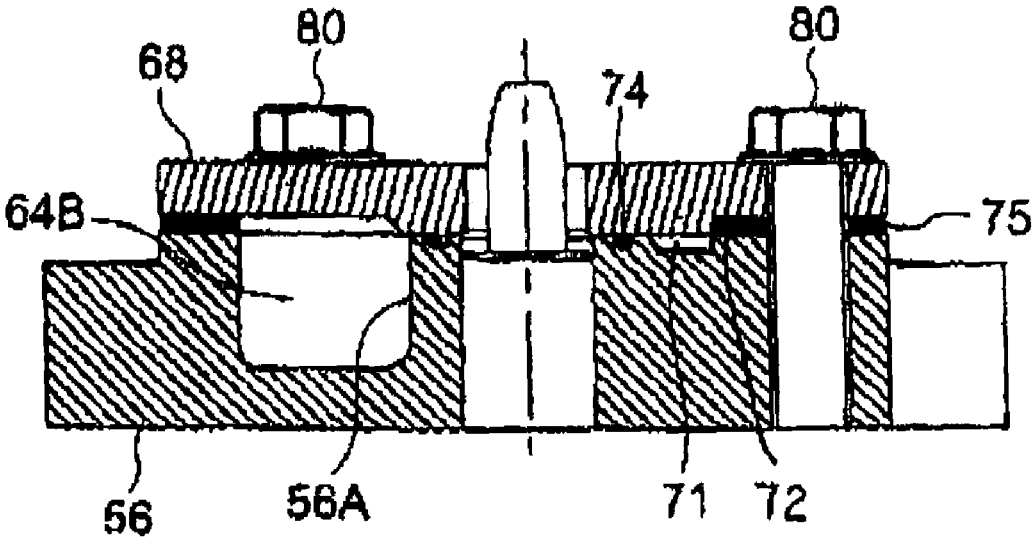
FIG. 4 is a sectional view showing the lower support member and the blocking plate, with a passage disposed in the support member.
Figure 5:
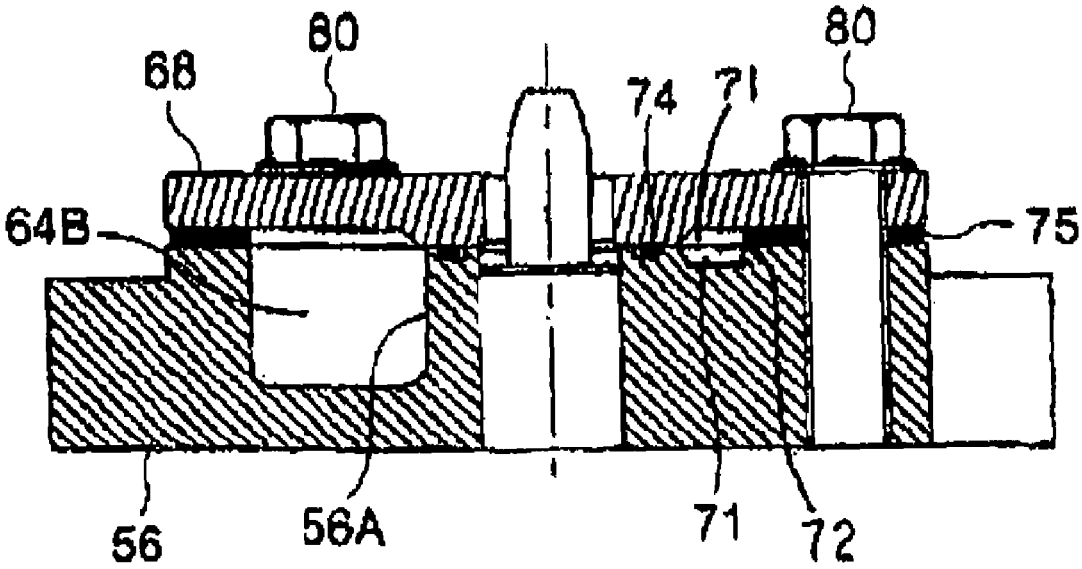
FIG. 5 is a sectional view showing the lower support member and the blocking plate, with a passage disposed in both the support member and the blocking plate.

Moreover, in the present embodiment, the blocking plate 68 is provided with the communication passage 71 which communicates with the intermediate pressure discharge muffling chambers, but this communication passage 71 may be disposed in the ribs 72 which reinforce the bearing 56A as shown in FIG. 4 or maybe disposed in both of the blocking plate 68 and the ribs 72 as shown in FIG. 5.

Furthermore, in the present embodiment, it has been described that the rotary shaft is of a vertically disposed type, but needless to say, the present invention may be applied to the rotary compressor having a rotary shaft of a horizontally disposed type. It has been described carbon dioxide is used as the refrigerant of the rotary compressor, but another refrigerant may be used.

What is claimed is:

1. A rotary compressor including, in a sealed vessel, a driving element and first and second rotary compression elements driven by the driving element, the rotary compressor being configured to suck, in the second rotary compression element, an intermediate pressure refrigerant gas compressed by the first rotary compression element and discharged, compress and discharge the refrigerant gas into the sealed vessel, the rotary compressor further comprising:

a cylinder constituting the first rotary compression element;

a support member blocking an opening surface of the cylinder and having a bearing of a rotary shaft;

a concave portion formed in the surface of the support member on a side opposite to the cylinder;

a rib which is formed in a part of the concave portion and which reinforces the bearing; and a discharge muffling chamber defined by the rib and the concave portion and a blocking plate which blocks the concave portion, the discharge muffling chamber is divided into a plurality of muffling chambers by the rib, and the muffling members are connected by a passage disposed in the blacking plate and/or the rib.

* * * * *